United States Patent [19]

Glick

[11] 4,063,110

[45] Dec. 13, 1977

[54] SECURITY DEVICE

[76] Inventor: Michael B. Glick, 2865 Turk Blvd., San Francisco, Calif. 94118

[21] Appl. No.: 648,459

[22] Filed: Jan. 12, 1976

[51] Int. Cl.[2] ..... H01H 19/04

[52] U.S. Cl. ..... 307/112; 174/67; 361/357; 200/44

[58] Field of Search ..... 307/112, 114; 317/99; 200/42 R, 50 A, 51 R, 44, 50 B, 42 T, 333, 334; 174/67; 339/37, 44 R, 75 R; 70/DIG. 34, 63, 70; 361/357

[56] References Cited

U.S. PATENT DOCUMENTS

| | | | |
|---|---|---|---|
| 1,636,809 | 7/1927 | DeGroot | 70/70 |
| 2,439,708 | 4/1948 | Abraham | 200/50 A |
| 3,131,985 | 5/1964 | Blonder | 339/37 |
| 3,453,402 | 7/1969 | Suber | 200/44 |
| 3,524,029 | 8/1970 | Laff | 200/51 R |
| 3,659,442 | 5/1972 | Cellini et al. | 70/63 |

*Primary Examiner*—Robert K. Schaefer
*Assistant Examiner*—Morris Ginsburg
*Attorney, Agent, or Firm*—James G. O'Neill

[57] ABSTRACT

A portable security device comprised of a sturdy, lockable enclosure housing a standard electrical outlet. The electrical outlet is secured within the enclosure, and the power supply to the outlet is capable of being interrupted by the action of a keylock switch from the exterior of the enclosure. The wall of the enclosure opposite the outlet is provided with one or more slots, aligned with one or more plug outlets. The enclosure includes a hinged cover, which may be unlocked and raised to allow standard electrical cords for external appliances or devices to be lowered into the slots, while the respective plugs are inserted into the aligned plug outlets. Each of the slots formed in the wall of the enclosure is only wide enough to accommodate the width of an ordinary electrical cord to thereby prevent the passage of the plug of the cord through the slot. When the cover of the enclosure is in the lowered position and locked in place, the cover insures retention of the plugs in their respective outlets.

4 Claims, 2 Drawing Figures

SECURITY DEVICE

BACKGROUND OF THE INVENTION

This invention relates generally to security devices for electrical appliances, and more particularly to a portable enclosure for use with electrical appliances not provided with security means. The invention allows the appliances to be rendered inoperative and incapable of use by unauthorized personnel.

Known devices for providing security to prevent unauthorized personnel from using electrical appliances have included means such as large expensive lockable coverings for the entire appliance or switch or other devices built into the appliance itself. These prior devices have tended to be bulky and hard to handle, or relatively expensive and complicated. Furthermore, in appliances not initially provided with some type of security at the factory, the addition of a security device was extremely costly or difficult and usually involved tools or knowledge of the appliance not readily available.

SUMMARY OF THE INVENTION

Accordingly, it is an object of this invention to provide a security device which may be easily adapted to presently existing electrical appliances to provide an inexpensive and easily operated means for rendering the appliances, so adapted, inoperative to unauthorized personnel.

It is another object of this invention to provide a security device with a locking mechanism for restricting the use of one or more electrical appliances without requiring any modification of the electrical appliances themselves.

It is still another object of this invention to provide a security device containing a locking mechanism for restricting the use of one or more electrical appliances which device may be installed without any tools or specialized knowledge of electricity or the appliances being used.

It is a further object of this invention to provide a simple, inexpensive security device for electrical appliances not so equipped which may be easily secured to a wall or other surface by the use of readily available tools.

These and other objects are obtained by providing a security device for holdng the plugs of electrical appliances and provided with means for interrupting the power supply to the plugs. This means comprises a key operated lock or switch, mounted in an enclosure between a main power supply and electrical plug outlets housed within the closure. The enclosure holding the electrical plug outlets and the plugs is further provided with a key operated lockable cover.

In this manner, the key which locks or unlocks the enclosure may be held by one person, while separate keys, only capable of operating the power supply switch may be issued to those persons authorized to use the electrical appliances.

Numerous advantages flow from this invention, including—but not limited to—the utilization of the separately housed electrical connection without requiring modification of any electrical appliances for use therewith. Since the electrical connection is the exact same as the usual wall plug outlet, no special training or tools are required to install the invention. Because of the simplicity of the invention, practically no maintenance is required. And, no impairment of the operation of the electrical appliances used with this invention will result since the normal power supply to the appliance will be used.

Many other objects, features and advantages of this invention will be more fully realized and understood from the following detailed description when taken in conjunction with the accompanying drawings wherein like reference numerals throughout the various views are intended to designate similar elements.

DETAILED DESCRIPTION OF THE ILLUSTRATED EMBODIMENT

Figures 1, 2:
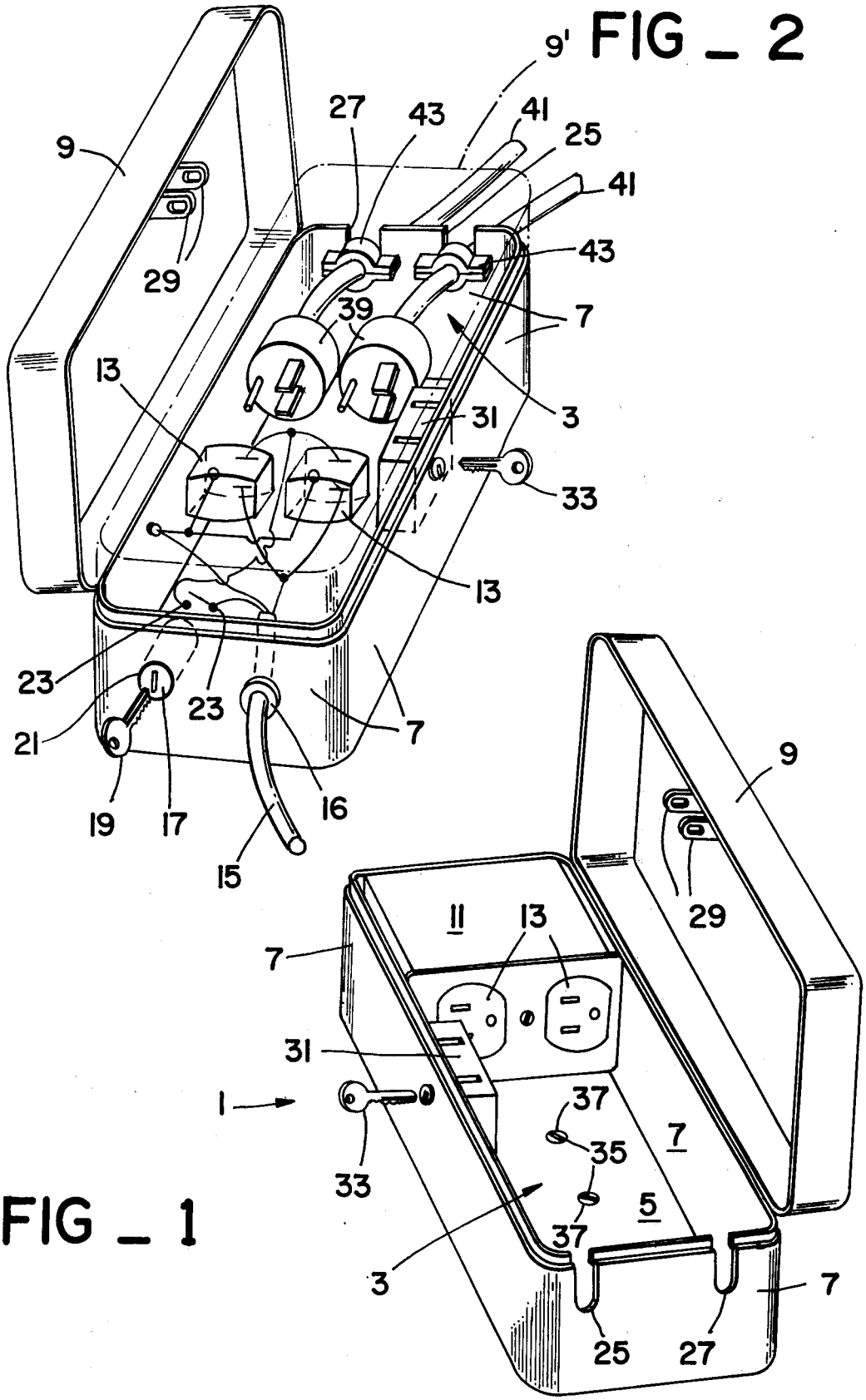
FIG. 1 is a perspective view of the security device of the present invention and illustrates an enclosure comprised of a lockable sturdy case housing a multioutlet electrical box.
FIG. 2 is a further perspective view of the security device of FIG. 1, looking from the opposite end and showing the electrical cord to the multioutlet box with the top plate of the box removed to show the schematic connection of the key operated power switch interposed between the inlet cord and the plug outlets; and, further illustrating plugs for external electrical appliances aligned with the outlets and the electric cords of the appliances lowered into slots formed in the opposed side wall of the casing.

Referring to FIGS. 1 and 2 of the drawings, there shown is a security device comprising a rigid hollow container 1, such as a metal or plastic box or casing. The enclosure contains a hollow interior 3 bounded by a bottom wall portion 5, four contiguous side wall 7 and a hinged top portion 9. An outlet box or plug receiving station 11 is securely held within the hollow interior of the enclosure in any convenient manner, as by screws or the like, not shown.

The outlet box is of conventional type, and contains at least one plug outlet or plug receiving aperature 13, two being shown in the drawings. An electrical cord 15 of the two or three wire type passes through a hole 16 formed in side wall 7. The other end of the cord 15 is connected to a convenient power supply, such as a wall outlet and is electrically connected to the plug outlets 13 as shown schematically in FIG. 2. To enable only authorized users to use any electrical appliances which may be plugged into the outlets 13, a switch 17, operated by a key 19 passing through a hole 21 in side wall 7 makes or breaks contact 23 to thereby shut off or turn on any electrical power to the plug outlets 13.

To provide further security, the present invention includes a pair of openings or slots 25, 27 formed in side wall 7 in such a manner that each slot is aligned with one of the plug outlets 13. The hinged top 9 is provided with fingers or ribs 29 which form a locking portion which extend into and are held in position by a lock 31 fixed to the top inner portion of side wall 7. The lock 31 is operated by a key 33 which may be held in a safe place, or controlled in its use by selected persons.

In use, the security device may be placed on any convenient surface, or may be secured to a wall or other surface such as the back plate of a large appliance or device by fasteners such as the pair of screws 35 passing through complementary holes 37 formed in bottom wall 5. After the security device is in place, one or more electrical appliances or devices may be plugged into the plug outlets. As shown in FIG. 2 plugs 39 attached to cords 41 from electrical appliances, not shown, are inserted into plug outlets 13. The cords 41 just pass through slots 25, 27 and the cords may be knotted or clips 43 may be mounted on the cords to prevent the plugs from being pulled from the outlet in the horizontal direction when the cords 41 rest in the slots. Top 9 is then brought to the closed position, shown in phantom at 9' in FIG. 2, and the fingers 29 are held in lock 31 to lock the top in the closed position. The locked top prevents vertical movement of the cords 41, so that the plugs 39 cannot be removed from the outlets unless the top is opened by someone having the key 33, destruction of the enclosure 1, or cutting of the cords 41.

Therefore, with the contacts 23 in the open position, the enclosure 1 fixed to a wall or other surface, the plugs 39 in the outlets 13, and the top 9 locked down in the closed position, the electrical appliances connected to the cords 41 will be inoperative, and an unauthorized user will be prevented from operating the same. Only an authorized user having a key 19 to operate switch 17 to provide power to the outlets 13, or a key 33 to open the top 9 and physically remove the plugs 39 to plug them into another power supply, will be able to use the electrical appliances.

What has been described is a simple and inexpensive device capable of providing usage security to any electrical appliance or device, not so equipped, requiring no special tools for installation or knowledge of the devices to be utilized.

While the invention has been described in considerable detail, it is not to be limited to such details as have been set forth except as may be necessitated by the appended claims.

What is claimed is:

1. A security device comprising a rigid container having a bottom wall portion, a plurality of contiguous side wall portions and a hinged top portion having complementary locking fingers thereon, all of said portions bounding a hollow interior with a key operated lock fixed to the interior of one of said side wall portions; said hinged top portion being moveable between a closed position and an open position away from said hollow interior; a plug receiving station having two plug receiving apertures fixedly secured within said hollow interior, and being connected to a power supply by an electrical cord passing through an opening formed within one of said side wall portions; two slots formed in the side wall portion opposite to said side wall portion having the opening formed therein, and in alignment with said two plug receiving apertures, whereby when a plug of an electrical appliance is inserted in either or both of said apertures, a cord attached to said plug will pass through the aligned slot to enable said hinged top portion to be moved to the closed position and move said complementary locking fingers into said key operated lock to releasably capture said plug within said hollow interior.

2. The security device of claim 1 wherein said plug receiving station includes a switch to control power thereto; said switch being operated by a key passing through a further opening formed in the side wall portion through which said electrical cord passes; said key moving said switch to make or break switch contacts mounted within said plug receiving station to thereby switch on and off said power thereto.

3. The security device of claim 1 including clip means mounted over said cord of an electrical appliance passing through either or both of said slots on the hollow interior to prevent said plug of an electrical appliance from being pulled out of either or both of said plug receiving apertures when said top portion is in the locked position.

4. The security device of claim 3 wherein said bottom wall portion includes a pair of holes extending therethrough to enable said security device to be fixed to a surface by screws passing through said holes.

* * * * *